United States Patent [19]

Skowronek et al.

[11] Patent Number: 4,520,052

[45] Date of Patent: May 28, 1985

[54] METHOD FOR ELECTROLESS COPPER-PLATING AND A BATH FOR CARRYING OUT THE METHOD

[76] Inventors: Jerzy Skowronek, Boktryckaregatan 35, Norrokoping; Jan O. Persson, Trestegsgatan 59, S 603 63 Norrkoping, both of Sweden

[21] Appl. No.: 561,618

[22] Filed: Dec. 15, 1983

Related U.S. Application Data

[63] Continuation-in-part of Ser. No. 392,048, filed as PCT SE 81/00366, Dec. 9, 1981, published as WO 82/02063, Jun. 24, 1982, § 102(e) date Jun. 25, 1982, abandoned.

[30] Foreign Application Priority Data

Dec. 9, 1980 [SE] Sweden ..... 8008634

[51] Int. Cl.[3] ..... C23C 3/02

[52] U.S. Cl. ..... 427/443.1; 106/1.23; 106/1.26; 427/98

[58] Field of Search ..... 427/443.1; 106/1.23, 106/1.26

[56] References Cited

U.S. PATENT DOCUMENTS

| | | | |
|---|---|---|---|
| 3,329,512 | 7/1967 | Shipley | 427/443.1 |
| 4,171,225 | 10/1979 | Molenaar | 106/1.23 |
| 4,211,564 | 7/1980 | Oka | 106/1.26 |

OTHER PUBLICATIONS

Saubestre, "Stabilizing Electroless Copper Solutions", Plating, June 1972, p. 563–566.

Concise Chemical and Technical Dictionary, Edited by Bennett, Chemical Publishing Co., 1974, pp. 92, 776, 669.

*Primary Examiner*—John D. Smith

*Attorney, Agent, or Firm*—Roberts, Spiecens and Cohen

[57] ABSTRACT

A method for electroless copper-plating comprising immersing a surface to be plated in a conventional bath of an alkaline aqueous solution of a cupric salt, a complexing agent for cupric (II) ions and reducing agents which additionally contain an oxide inclusion preventing agent of the formula $$R'R''N—R_3—COOH$$

wherein R′ and R″ each is hydrogen or alkyl and $R_3$ and aryl, the amino group and the carboxylic group being in para position with respect to each other. As a consequence of the addition of the agent for preventing oxide inclusions in the copper plating, the latter is provided with high ductility and this confers resistance to heat shock. Preferred embodiments of the agent for preventing oxide inclusions are p-aminobenzoic acid, p-methylaminobenzoic acid, p-dimethylaminobenzoic acid or p-aminosalicylic acid.

8 Claims, No Drawings

METHOD FOR ELECTROLESS COPPER-PLATING AND A BATH FOR CARRYING OUT THE METHOD

CROSS-RELATED APPLICATION

This application is a continuation-in-part of Ser. No. 392,048 filed June 25, 1982 now abandoned.

FIELD OF THE INVENTION

The present invention relates to a method for electroless copper-plating and to the composition of a bath for 392,048 filed as PCT SE 81/00366, Dec. 9, 1981, published as WO 82/02063, Jun. 24, 1982, § 102(e) date June 25, 1982 now abandoned.

BACKGROUND

Electroless copper-plating (chemical copper deposition) is a method to coat surfaces with thin copper layers and this method has been used extensively in the art, especially when manufacturing printed boards. A typical method for electroless copper-plating comprises the preparation of the surface to be copper-plated so that it will be catalytically active, whereupon the surface is immersed in a bath containing an alkaline aqueous solution, having a pH of from 11.5 to 13.5, of a cupric salt, a complexing agent for cupric ions, a first reduction agent of aldehyde type and optionally a second reduction agent as well as the usual additives in order to improve the stability of the bath and to lower its surface tension.

The reactions occuring upon chemical copper deposition are very complex and are not completely investigated. In principle, the copper deposition functions as a redox reaction where the reduction agent is oxidized during electron transfer to the cupric ions which are reduced to metallic copper. When using the known methods for electroless copper-plating and the known baths, it is difficult to obtain a copper layer which is ductile in the holes at a speed which is sufficiently high to enable a rational production. The copper layer, which constitutes the connection between the two sides of the printed board and also is the base of the soldered joint with the components is exposed to a heat shock when the component is soldered and this shock can break the connection. In accordance with standard specifications, the layer must resist a temperature of 260° C. for 10 seconds without having any fractures.

The methods and baths known up to now for chemical copper deposition produce deposited copper which is not sufficiently ductile at lower temperatures of the bath.

SUMMARY OF THE INVENTION

According to the present invention, it has surprisingly been found that the ductility of the deposited copper layer is considerably improved if the bath contains an oxide inclusion preventing agent having the following formula: R′ R″ N—$R_3$—COOH wherein R′ and R″ each is hydrogen or alkyl and $R_3$ is aryl, the amino group and the carboxylic group being in para position with respect to each other whereby to provide high ductility of the deposited copper and resistance to heat shock.

Preferred oxide inclusion preventing agents are p-aminobenzoic acid, p-methylaminobenzoic acid, p-dimethylaminobenzoic acid or p-aminosalicylic acid. In order to obtain the ductility improving effects of the oxide inclusion preventing agents used according to the invention, the amino group and the carboxylic group must be in para position with respect to each other. Tests with 2-aminobenzoic acid where the amino and carboxylic group are not in para position with respect to each other has shown that no improvement of the ductility is obtained.

The ductility improving effect of the compounds used according to the invention appears to be due to the fact that said compounds prevent the inclusion of cuprous oxide in the deposited copper layer. It is known that hydrogen is produced and that hydrogen gas is physically included in the copper. In the presence of cuprous oxide, the hydrogen gas may form water which results in water brittleness and accordingly fractures.

PRIOR ART

CA54 (1960) 1133F mentions the addition of aminobenzoic acid to a bath for electrolytic and not electroless copper-plating and the purpose of the addition of the aminobenzoic acid is to prevent the poisining action of impurities formed in the electrolyte during the copper-plating and to increase the brightness of the deposited copper. The problem of increasing the ductility of the deposited copper layer is not contemplated and there is no teaching that the ductility can be improved in electroless copper-plating when using an amino acid compound of the type according to the invention.

CA76 (1972) 161561t also relates to a bath for electrolytic copper-plating and has nothing to do with electroless copper-plating. This abstract shows that the limiting current and thus the deposition rate can be improved by certain additives and para-aminobenzoic acid is such an additive. However, the activity of the para-aminobenzoic acid is said to be equivalent to the activity of the compound $H_2NCH_2CHMeNH_2$ which does not contain any carboxylic group in para position with respect to the amino group. This abstract does not teach that compounds of the invention where the amino and carboxylic groups are in para position with respect to each other improve the ductility of the deposited copper layer in electroless copper-plating.

DESCRIPTION OF PREFERRED EMBODIMENTS

The constituents of the bath, in addition to the agent for preventing oxide inclusions, comprises a water-soluble copper salt such as cupric sulphate or cupric chloride, a complexing agent such as EDTA or salts of hydroxy carboxylic acid, for example Rochelle-salt, and a reducing agent such as formaldehyde. The bath additionally comprises:

(a) An admixture to reduce the particle size of the deposited copper having the general formula:

$$R_x—R_1—S—R_2—R_y$$

where $R_1$ and $R_2$ are alkyl or aryl groups and $R_x$ and $R_y$ are functional groups to make the compound water-soluble and which can be a hydroxy, sulphuric or amine group. A typical compound is 2,2 thiodiethanol.

(b) A Lewis axis, preferably an organic acid such as benzene sulphuric acid, citrid acid or amido sulphuric acid, or a boron or an aluminum compound.

(c) A wetting agent such as polyethyleneglycol having a high molecular weight.

It is also suitable to add another weak reducing agent in addition to the formaldehyde, which is so adjusted to the complexing agent that the reducing agent in itself cannot cause copper deposition. An example of reducing agents which can be used for this purpose are hypophosphites, thio-sulphates, sulphites or a compound of molybdenum or tungsten. Further additives include Triton-100 to reduce the surface tension.

EXAMPLES

Example 1

A plate made of glass fibre reinforced epoxy plastic which is laminated on both sides with copper foils of a thickness of 35 μm was provided with a desired hole pattern by means of drilling. After conventional degreasing and pre-etching to remove grease and oxides, the plate is immersed into a bath for electroless copper-plating having the following composition:

| | |
|---|---|
| Cupric chloride | 6 g/l |
| EDTA | 30 g/l |
| Sodium hydroxide | 4 g/l |
| Formaldehyde | 2 g/l |
| P-amino benzoic acid | 0.2 g/l |
| 2,2 thiodiethanol | 20 mg/l |
| Amido sulphuric acid | 25 g/l |
| Polyethyleneglycol (M 20000) | 0.2 g/l |
| Sodium hypophosphite | 10 g/l |
| Triton X-100 | 0.01 ml/l |

Sodium hydroxide was added so that the pH-value of the bath was between 12.0 and 12.4. The temperature of the bath was kept between 60° and 62° C. After about 30 minutes a copper layer of about 2–3 μm was deposited on the copper foil surfaces of the plate and on the walls of the holes. The surfaces of the plate were provided with a layer of dry film resist and the resist was exposed and developed so that the conductive pattern and the holes were covered with hardened resist. The copper foil outside the conductive pattern was etched away by means of a conventional etching agent. The photo resist was removed by means of a conventional solvent and after a new pre-etching of the remaining copper surface, the entire surface of the plate except the holes and the lands around them was covered with a soldering and insulation mask of epoxy type. Once again the plate was immersed into the copper-plating bath for about 6 hours resulting in the deposition of a copper layer 25–27 μm thick. The temperature of the bath was again kept between 60° and 62° C.

The deposited copper layer has a metallic lustre and sufficient ductility to withstand a heat shock test of 260° C. for 10 s.

Example 2

The same method was used as in Example 1, but the composition of the bath was the following:

| | |
|---|---|
| Cupric chloride | 6 g/l |
| EDTA | 30 g/l |
| Sodium hydroxide | 4 g/l |
| Formaldehyde | 2 g/l |
| 2,2 thiodiethanol | 20 mg/l |
| P-amino benzoic acid | 0.3 g/l |
| Boric acid | 25 g/l |
| Polyethyleneglycol (M 20000) | 0.2 g/l |
| Sodium hypophosphite | 10 g/l |
| Triton X-100 | 0.01 ml/l |
| Water up to the volume of 1 l. | |

The bath was kept at the same temperature and pH-value as in Example 1.

The appearance and the ductility are completely comparable with the appearance and the ductility obtained with the bath according to Example 1.

Example 3

The same method was used as in Example 1, but the composition of the bath was the following:

| | |
|---|---|
| Cupric chloride | 6 g/l |
| EDTA | 28 g/l |
| Sodium hydroxide | 4 g/l |
| Formaldehyde | 2 g/l |
| 2,2 thiodiethanol | 20 mg/l |
| P-amino benzoic acid | 0.3 g/l |
| Aluminum chloride | 10 g/l |
| Polyethyleneglycol (M 20000) | 0.2 g/l |
| Sodium hypophosphite | 10 g/l |
| Triton X-100 | 0.1 ml/l |
| Water up to the volume of 1 l. | |

The bath was kept at the same temperature and pH-value as in Example 1. The appearance the ductility were completely comparable with the appearance and the ductility obtained with the bath according to Example 1.

The bath compositions in the above Examples are only to be considered as exemplary. The components which are included can vary within the following limits by permitting certain parameters such as the deposition speed to vary.

| | |
|---|---|
| Copper content in the copper salt used | 0.1–6 g/l |
| Complexing agent (EDTA) | 13.5–60 g/l |
| Base (Sodium hydroxide) to pH 11.0–13.5 | |
| Reducing agent (formaldehyde) | 0.1–6 g/l |
| Fine grain promotor agent (2,2 thiodiethanol) | 1 mg–1 g/l |
| preferably | 10–100 mg/l |
| Oxide inhibiting agent | 20 mg solubility limit |
| preferably | 50–500 mg/l |
| Lewis acid (such as amido sulphuric acid) | 1–100 g/l |
| preferably | 5–25 g/l |
| Wetting agent | 10 mg–1 g/l |
| preferably | 50–500 mg/l |
| Second reducing agent depending on the copper concentration and the desired speed | 0.5–50 g/l |
| normally | 1–15 g/l |

Example 4

For this Example use was made of an ordinary high-depositing standard bath (Shipley CP 78). The test was carried out by electroless plating at 53°–58° C. of a panel having a surface area of about 16 $cm^2$ for 4 hours. Prior to the electroless plating the panel had been copper-plated chemically to a thickness of about 1.7 μm by use of standard techniques.

In order for the bath not to decompose at the increased operation temperature, there were added to each sample 2 mg of αα-bipyridine per liter. 5 different tests were carried out with the following baths:

(0)=only the basic bath (a conventional bath taken from production)

(1)=basic bath according to (0)+0.3 g/liter of p-amino-benzoic acid (2)=basic bath according to (0)+0.34 g/liter of p-amino-methylaminobenzoic acid (3)=basic bath according to (0)+0.36 g/liter of p-dimethyl-aminobenzoic acid (4)=basic bath according to (0)+0.30 g/liter of p-amino-salicylic acid Upon completion of plating, the panels were heated at 135° C. for 2 hours whereupon they were allowed to cool, were etched and dip-soldered at 260° C. for 10 seconds. Upon soldering, the panels were cast in a thermoplastic material, the hole center was exposed by grinding and the chemically deposited copper was evaluated in respect of the soldering resistance.

The use of the conventional bath and the low plating temperature (the normal plating temperature is from 65° to 75° C.) was made in order to provoke any differences as to the activity of the different additives. When evaluating the resistance to soldering shock, the following results were obtained for the different baths expressed as percentage of hole corners not being damaged in the test:

0=0%
1=8.3%
2=44.0%
3=100%
4=15%

As evident from the above, the agents for preventing oxide inclusions have the effect of providing ductility for the copper layer such that when the coated panels are subjected to heat shock, there is substantial improvement concerning damage of the hole corners.

While the invention has been described in relation to specific embodiments of oxide inclusion preventing agents, it will become apparent to those skilled in the art that numerous modifications and variations can be made within the scope and spirit of the invention as defined in the attached claims.

What is claimed is:

1. In a method for electroless copper plating comprising immersing the surface to be plated in a bath comprising an alkaline solution, having a pH of 11.5–13.5, of a cupric salt, a complexing agent for cupric (II) ions, a reduction agent of aldehyde type and additives to improve the stability of the bath and to lower its surface tension, the improvement wherein the bath additionally contains an oxide inclusion preventing agent of the formula $$R'R''N—R_3—COOH$$

wherein R′ and R″ each is hydrogen or alkyl and $R_3$ is phenyl, the amino group and the carboxylic group being in para position with respect to each other whereby to provide high ductility of the deposited copper and resistance to heat shock.

2. A method according to claim 1, wherein the agent for preventing oxide inclusions is p-aminobenzoic acid, p-methylaminobenzoic acid, p-dimethylaminobenzoic acid or p-aminosalicylic acid.

3. In a method as claimed in claim 1 wherein the bath additionally contains a second reduction agent.

4. In a bath carrying out an electroless plating process comprising an alkaline aqueous solution, having a pH of 11.5–13.5, of a cupric salt, a complexing agent for cupric (II) ions, a reduction agent of aldehyde type and additives to improve the stability of the bath and to lower its surface tension, the improvement wherein the bath additionally contains an oxide inclusion preventing agent of the formula $$R'R''N—R_3—COOH$$

wherein R′ and R″ each is hydrogen or alkyl and $R_3$ is phenyl, the amino group and the carboxylic group being in para position with respect to each other whereby to provide high ductility of the deposited copper and resistance to heat shock.

5. A bath according to claim 4, wherein the agent for preventing oxide inclusions is present in the bath in an amount from 50 to 500 mg per liter.

6. A bath according to claim 4, wherein the agent for preventing oxide inclusions is p-aminobenzoic acid, p-methylaminobenzoic acid, p-dimethylaminobenzoic acid or p-aminosalicylic acid.

7. A bath according to claim 5, wherein the agent for preventing oxide inclusions is p-aminobenzoic acid, p-methylaminobenzoic acid, p-dimethylaminobenzoic acid or p-aminosalicylic acid.

8. In a bath as claimed in claim 4 additionally containing a second reduction agent.

* * * * *